United States Patent [19]

Vadla et al.

[11] 4,001,104

[45] Jan. 4, 1977

[54] CEMENTED COLLECTOR BAR ASSEMBLIES FOR ALUMINUM CELL CARBON BOTTOM BLOCK

[75] Inventors: Jostein J. Vadla, Rocky River; Robert G. Milner, Bay Village, both of Ohio

[73] Assignee: Union Carbide Corporation, New York, N.Y.

[22] Filed: Jan. 3, 1974

[21] Appl. No.: 430,385

[52] U.S. Cl. ..... 204/243 R; 156/305

[51] Int. Cl.[2] ..... C25 C3/08

[58] Field of Search ..... 204/67, 243 R, 244, 204/247, 294, 289

[56] References Cited

UNITED STATES PATENTS

| | | | |
|---|---|---|---|
| 1,126,253 | 1/1915 | Morris | 156/305 XR |
| 2,728,109 | 12/1955 | Bonnot | 204/294 X |
| 3,334,040 | 8/1967 | Conrad et al. | 204/266 |
| 3,468,737 | 9/1969 | Hildebrandt et al. | 156/293 |
| 3,764,509 | 10/1973 | Etzel et al. | 204/294 X |
| 3,787,311 | 1/1974 | Wittner et al. | 204/294 |

FOREIGN PATENTS OR APPLICATIONS

| | | |
|---|---|---|
| 863,999 | 2/1954 | Germany |

*Primary Examiner*—Gerald L. Kaplan
*Assistant Examiner*—D. R. Valentine
*Attorney, Agent, or Firm*—Israel Blum

[57] ABSTRACT

A method for constructing a metallic collector bar-carbonaceous block assembly for the cathode bottom of an aluminum reduction cell comprising (a) positioning a metallic collector bar within a reduction cell on the bottom surface thereof so that the ends of the bar extend through the cell and connect to an external cathode bus system (b) depositing a layer of binder comprising an electrically conductive, carbonaceous cement onto the exposed surface of the bar, (c) positioning a prebaked carbonaceous cathode block having a transverse slot along its length, in the bottom surface thereof, astride the bar to firmly embed the bar within the slot, the slot having a width exceeding the width of the bar and a depth shallower than the height of the bar.

10 Claims, 4 Drawing Figures

CEMENTED COLLECTOR BAR ASSEMBLIES FOR ALUMINUM CELL CARBON BOTTOM BLOCK

FIELD OF INVENTION

Figure 1:
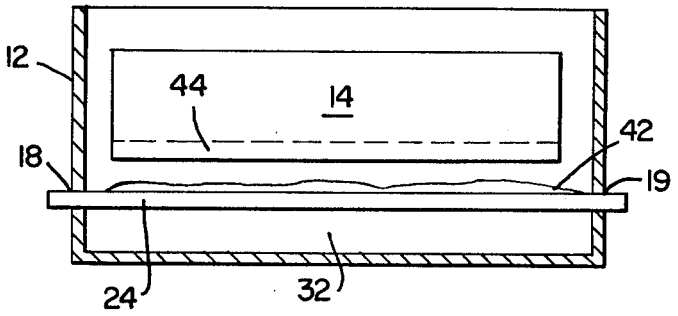

This invention relates to an improved method for installing a metallic collector bar-cathode carbonaceous block assembly in an electrolytic cell for the reduction of aluminum.

In the cathode bottom of an electrolytic "Hall" cell or pot used in the reduction of aluminum, current conveying metallic bars, usually made of steel or iron, are connected with a carbonaceous lining, usually consisting of carbon or graphite blocks. The conductive, metallic bars convey current away from the cathode reduction zone in the aluminum reduction cell to an external cathode bus system. Conventionally, each bar has a substantially square cross-sectional area and fits within a double dovetail slot in a carbonaceous bottom block. Nevertheless, a clearance still remains between all sides of each bar and slot which is conventionally filled with molten cast iron or a conductive carbonaceous ramming paste, resulting in so called assemblies of "cast iron rodded blocks" or "paste rodded blocks". The clearance may also be filled using an expanded graphite conductive cement as taught in British Pat. No. 883,676.

The bar-block assembly poses difficulties during installation into the aluminum pot which essentially comprises a steel shell lined with carbon or graphite. The ends of the bar must extend outside the shell walls to provide means for connection to the cathode bus. Since the bar ends protrude outside the shell the length of the bar in the bar-block assembly exceeds the shell width. Consequently, the assembly must skillfully be lowered into position in the shell, commonly by use of a crane. Generally, one end of the bar-block assembly is angled into the shell until the bar at that end protrudes through a first slot in a shell wall. The other end is then maneuvered downward into the shell until the bar at that end is aligned with a second slot in a shell wall, opposite to and coaxially aligned with the first slot. Then the bar-block assembly is skillfully maneuvered back and forth until the ends of the bar each extend a predetermined distance through slots in opposite side walls of the shell.

Positioning the bar-block assembly, however, mandates that the length of the block be at least approximately 16 to 32 inches shorter than the shell width to allow room for maneuvering. This leaves void a peripheral area between block ends and the shell walls, approximately 8 to 16 inches wide on each end of the block. A ramming paste is commonly used to fill in this peripheral area and later form the aluminum pot walls. The wall ramming paste generally barely covers the peripheral pasted area. When the wall paste is "baked in," its shrinkage may result in cracks opening up between blocks and paste in the peripheral area through which molten aluminum may reach the steel or iron bars, dissolve these, and eventually tap out.

Moreover, a "cast iron rodded block" requires either than the cast-in connection be made at a foundry of that foundry facilities be maintained at the aluminum plant, either alternative being expensive. Although paste rodding of blocks is cheaper, a "paste rodded block" provides substantially less electrical conductivity due to the relatively high resistivity of the ramming paste. Furthermore, conventional types bar-block assemblies must be handled during each successive step in building the cathode bottom with attendant labor, material, and breakage problems.

SUMMARY OF THE INVENTION

It is an object of this invention to provide an improved method for constructing a metallic collector bar-cathode carbonaceous block assembly in an electrolytic cell for the reduction of aluminum. An object of this invention is to minimize the width of the peripheral seam between shell walls and blocks by using blocks as long as mutual tolerances between shell walls and blocks permit. Another object is to provide an electrical connection between bar and block which is less expensive than a cast iron rodded assembly, yet having an electrical conductivity equivalent thereto. A further object of this invention is to provide a cheaper and quicker on-line pot construction, eliminating excessive handling of the bar and block during assembly.

Briefly, this invention relates to an improved method for constructing a metallic collector bar carbonaceous bottom block assembly in an electrolytic cell for the reduction of aluminum comprising the steps of (a) positioning a conductive, metallic collector bar within a reduction cell, the ends of the bar protruding a predetermined distance through openings in oppositely situated side walls of the reduction cell and (b) depositing a layer of a binder comprising an electrically conductive, carbonaceous cement onto the exposed surface of the bar, the cement having plasticity at room temperature and (c) positioning a prebaked carbonaceous cathode block having a transverse slot along its length, in the bottom surface thereof, astride the bar to firmly embed the bar within the slot, the slot having a width exceeding the bar width and a depth shallower than the bar height, the binder securing the bar to the block. Any excess cement not necessary in binding the bar within the slot is forced down the sides of the slot by the weight of the block.

Figure 2:
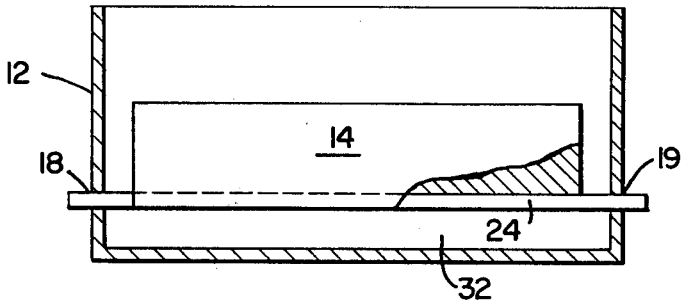
Figure 3:
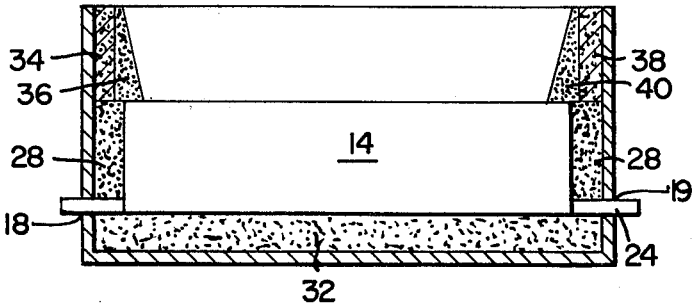
Figure 4:
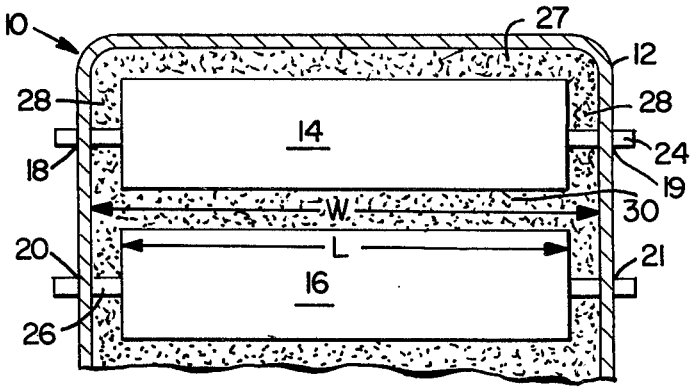

This invention will be described in greater detail by referring to the drawings wherein FIG. 1 is a side view in section of a cathode bottom of an aluminum pot prior to connection of the bar-block assembly. FIG. 2 is an explanatory side view in section including a cutaway portion of the cathode bottom of the aluminum pot shown in FIG. 1, subsequent to setting the block astride the bar. FIG. 3 is an explanatory side view in section of the cathode bottom of the aluminum pot shown in FIG. 2 subsequent to the construction of the aluminum pot walls. FIG. 4 is a plan view of a cathode bottom of an aluminum pot.

With reference now to the drawings, there is shown in FIG. 1 steel shell 12, a bottom insulation layer 32, metal collector bar 24, a layer of binder comprising an electrically conductive, carbonaceous cement 42, slots 18 and 19 in opposite side walls of the shell 12, carbonaceous block 14 and slot 44 along the bottom surface of the carbonaceous block 14. A layer of insulation 32 forms the bottom surface within the aluminum pot. Metal collector bar 24 is seated upon layer of insulation 32. The ends of metal collector bar 24 extend outside the shell 12 protruding through slots 18 and 19 located in opposite side walls of the steel shell 12 and coaxially aligned with respect to one another. Carbonaceous block 14 having slot 44 along its bottom surface is depicted prior to its positioning upon metallic collector bar 24 which has a layer of binder comprising an electrically conductive, carbonaceous cement 42 upon its top exposed surface.

FIG. 2 illustrates the cathode bottom of an aluminum pot at a later stage of development than shown in FIG. 1. Metal collector bar 24 seats on a layer of insulation 32 within the steel shell 12 and the ends of metal collector bar 24 protrude through slots 18 and 19 located in opposite side walls of steel shell 12 and coaxially aligned with respect to one another. FIG. 2 illustrates the point in construction of the cathode bottom of an aluminum pot according to the process of this invention wherein carbonaceous block 14 has been placed astride metal collector bar 24. Metal collector bar 24 is seated within a mating groove (shown in the cut-away portion of FIG. 2) in the bottom surface of carbonaceous block 14 and bound to the block 14 by a layer of binder comprising an electrically conductive, carbonaceous cement (not shown).

FIG. 3 illustrates the cathode bottom of an aluminum pot at a later stage of development than shown in FIGS. 1 and 2. Metal collector bar 24 seats on a layer of insulation 32 within the steel shell 12. The ends of metal collector bar 24 protrude through slots 18 and 19 located in opposite sidewalls of steel shell 12 and coaxially aligned with respect to one another. Metal collector bar 24 is secured to carbonaceous block 14 within a grove (not shown) in its bottom surface by a layer of binder (not shown). The peripheral area between the ends of block 14 and shell 12 is filled with a ramming paste 28. The aluminum pot walls 34 and 38 are made from prebaked carbon or graphite blocks placed against the steel shell 12 with ramming paste 36 and 40 built up at an angle as shown in FIG. 3. The ramming paste 36 and 40 extends from carbonaceous block 14 at a point substantially proximate to the top ends thereof sloping upwards toward the top of the aluminum pot walls 34 and 38 and extending thereof. Aluminum pot walls 34 and 38 may also be formed by means of a steel form (not shown) placed in the aluminum pot and filled with ramming paste.

FIG. 4 illustrates the cathode bottom 10 of an aluminum pot having steel 12, carbonaceous blocks 14 and 16, slots 18, 19, 20 and 21 in opposite side walls of the shell 12 and metal collector bars 24 and 26. Metal collector bar 24 is seated within a mating groove (not shown) in the bottom surface of carbonaceous block 14. The ends of bar 24 protrudes through slots 18 and 19 located in opposite side walls of the steel shell 12 and coaxially aligned with respect to one another. Similarly, metal collector bar 26 is seated within a mating groove (not shown) in the bottom surface of carbonaceous block 16, and the ends of bar 26 extend outside the shell 12 through slots 20 and 21, located in opposite side walls of the shell 12 and coaxially aligned with respect to one another. A peripheral ramming paste seam 28 fills the void area between the ends of blocks 14 and 16 and steel shell 12. Seam 27 between the steel shell 12 and an adjacent side of carbonaceous block 14 as well as seam 30 between adjacent sides of carbonaceous blocks 14 and 16 are filled with ramming paste. The width, W, of the shell exceeds the length, L, of the carbonaceous blocks 14 and 16.

The method of applicant's invention eliminates the step of casting or securing a metallic collector bar into a carbonaceous bottom block before positioning the assembled "rodded block" within the aluminum pot. By the method of applicant's invention, a collector bar such as bar 26 is placed upon the bottom surface within an aluminum pot 10, the bottom surface being a layer of insulation 32. Preferably the insulation is set or otherwise sufficiently rigid and fixed in position to support the metal collector bars. However, any suitable means of insulations may be used. Normally a granular insulation such as alumina, is disposed between the steel shell and the carbonaceous lining to conserve the heat generated during the electrolysis process. A layer of hardboard or sheet metal is preferably placed on top such an insulation bed to insure that the bars do not sink into the bed. In a manner similar to the maneuvering of a bar-block assembly into position, the collector bar 26 alone is lowered downward at an angle into the pot one end at a time until both ends of the bar are projecting a predetermined distance through slots 20 and 21.

Since the collector bar 26 along undergoes the manipulations, the carbonaceous block 16 need not be shortened to permit a margin to maneuverability. Indeed, the carbonaceous block 16 is preferably formed as long as mutual tolerances between the ends of block 16 and shell 12 of the aluminum pot will permit, the shell width, W, always exceeding the block length, L. Thus, the width of said cell measured between said side walls exceeds the length of said block by a distance insufficient to permit removal of said bar-block assembly as a unit from said cell. A longer block minimizes the width of a peripheral paste seam 28 that will fill the space between the ends of block 16 and shell 12 of the aluminum pot 10. Furthermore, a longer block brings the joint between block and paste further away from the center portion of the aluminum pot and towards the shell walls, a cooler region during electrolysis, thus minimizing bottom failure from this cause. It has been discovered that the side wall tamped joint 28 can be reduced to a thickness of about 1 inch to about 12 inches, preferably about 1 inch.

Thus, the combined thickness of the two side wall tamped joints 28 on either side of each block is equal to about 2 inches to about 24 inches which is the distance by which the width, W. of the aluminum cell exceeds the block length, L. The thickness of the seam 30 between blocks 14 and 16 which is also tamped full of carbon paste or ramming paste of the same type and quality as the carbon block can be reduced to about 2 inches.

After the collector bar has been positioned properly in the aluminum pot, a layer of binder comprising an electrically conductive, carbonaceous cement 42, plastic at room temperature, is deposited onto the exposed upper surface of a collector bar 24. The binder may consist wholly of an electrically conductive, carbonaceous cement 42 which may be spread onto the bar 24, to provide a complete and continuous coating or it may be combined with a metal powder such as steel or copper and applied as a slurry or paint. Additionally, it may be pressure pumped to form a thick bead on the bars. Other binders may be suitable, but it is esssential that a binder useful in this invention have considerable room temperature plasticity and maintain good electrical conductivity between bar and block at the elevated temperatures during the operation of the aluminum pot.

Once the binder comprising an electrical conductive, carbonaceous cement 42 has been deposited. a prebaked carbonaceous cathode block 14, preferably rectangularly shaped and having a transverse slot 44 in the bottom surface thereof, is set astride the so-coated collector bar to firmly embed the bar 24 within the slot 44. This binds the bar 24 and block 14 together into a unified structure. The transverse slot 44 extends wholly across a face of the block having a length L along a line defined by an imaginary division of the block width into two parts, preferably equal parts. Furthermore, preferably the width of the transverse slot exceeds the bar width and the depth of the transverse slot is less than the height of the bar.

Using the method of this invention obviates the need to handle blocks excessively and depend on crane time for installation. Blocks shipped slot side down need only be picked up during unloading for storage and placement into the pot. In addition, since bar and block are handled separately, individual pickups are sufficiently light so that pot installation can be handled easily, e.g., with cherrypicker type of mobile equipment or by means of portable monorail hoist temporarily attached to the shell. The blocks would be handled individually with scissor clamps or any other device designed to grip the ends or the sides and placed directly on the bars.

The following example illustrates the method of this invention:

EXAMPLE

A standard mild steel hot rolled bar 4 × 4 inches in cross-section was positioned according to the method of this invention in the center of a thirteen block aluminum pot. The CFK grade test block had six conventional "cast iron rodded blocks" on each side of it. The test block had a slot 3⅞ inches deep and 4¼ inches wide machined in its bottom surface. An excess of a conductive cement, made by mixing equal weights of C–34 cement (commercially available from Union Carbide Corporation, New York, N.Y.) with steel powder (AW100, 100 mesh steel powder commercially available from the Alan Wood Co., Coshocton, Pa.), and plasticizing to the consistency of thick cream, was poured on the top surface of the bar.

The block was then picked up by a single cable choke and set down astride the bar at one end and on a short piece of 4 × 4 inch wood laid across the bar on the other end in order to be able to remove the cable. The wooden 4 × 4 inch piece was knocked out, allowing the block to drop onto the bar. Spaces between the block and the peripheral wall of the pot were then filled with ramming paste and the pot started as usual.

After one week of operation, the test block was checked against the other blocks by measuring voltage drop along a fixed length of all the bars. It was found to carry current equivalent to a similar cross-section of the "cast iron rodded blocks."

Although the foregoing invention has been described in some detail by way of illustration and example for purposes of clarity and understanding, it is understood that certain changes and modifications, that may be practiced are within the scope of the invention as claimed.

What is claimed is:

1. An improved method for constructing a conductive, metallic collector bar-carbonaceous block assembly in the cathode bottom of an aluminum reduction cell comprising the steps of:

a. positioning a metallic collector bar within a reduction cell upon the bottom surface thereof, the ends of said bar protruding a predetermined distance through openings in oppositely situated side walls of said cell, and b. depositing a binder comprising a layer of an electrically conductive, carbonaceous and plastic cement onto the exposed surface of said bar, and c. positioning a prebaked carbonaceous cathode block having a transverse slot along its length, in the bottom surface thereof, astride said bar to firmly embed such bar within said slot, said slot having a width exceeding the width of said bar and a depth shallower than the height of said bar, said binder securing said bar to said block the width of said cell measured between said side walls exceeding the length of said block by a distance insufficient to permit removal of said bar-block assembly as a unit from said cell.

2. A method as defined in claim 1 wherein said metallic collector bar comprises a member selected from the group consisting of steel or iron and said carbonaceous block comprises a member selected from the group consisting of carbon or graphite.

3. A method as defined in claim 2 wherein said metallic collector bar is rectangularly shaped.

4. A method as defined in claim 2 wherein the width of said cell measured between said side walls exceeds the length of said block by at least a distance of about 2 inches to about 24 inches.

5. A method as defined in claim 4 wherein said distance is at least about 2 inches.

6. A method as defined in claim 2 wherein said bottom surface comprises a layer of insulation.

7. A method as defined in claim 6 wherein said layer of insulation comprises alumina.

8. A method as defined in claim 2 wherein said binder further comprises a metal powder.

9. A method as defined in claim 8 wherein said metal powder is a member selected from the group consisting of steel, copper and iron.

10. A method as defined in claim 2 wherein said slot extends wholly across a face of said block along a line defined by an imaginery division of said block into two equal parts.

* * * * *